US007810365B2

(12) United States Patent
Villani

(10) Patent No.: US 7,810,365 B2
(45) Date of Patent: Oct. 12, 2010

(54) LOCK CYLINDER WITH LOCKING MEMBER

(75) Inventor: Christopher J. Villani, Davidson, NC (US)

(73) Assignee: Schlage Lock Company, Carmel, IN (US)

( * ) Notice: Subject to any disclaimer, the term of this patent is extended or adjusted under 35 U.S.C. 154(b) by 493 days.

(21) Appl. No.: 11/762,878

(22) Filed: Jun. 14, 2007

(65) Prior Publication Data

US 2008/0307842 A1 Dec. 18, 2008

(51) Int. Cl.
*E05B 27/04* (2006.01)

(52) U.S. Cl. ..... 70/419; 70/493; 70/495

(58) Field of Classification Search ..... 70/419, 70/492, 493, 495, 392, 376–378, 358, 359, 70/421, DIG. 1, DIG. 2, DIG. 22, DIG. 23, 70/DIG. 24, DIG. 29, 372, 494, 496
See application file for complete search history.

(56) References Cited

U.S. PATENT DOCUMENTS

| | | | | | |
|---|---|---|---|---|---|
| 598,469 | A | * | 2/1898 | Mouat | 70/340 |
| 621,875 | A | * | 3/1899 | Voight | 70/419 |
| 711,376 | A | * | 10/1902 | Bayer | 70/493 |
| 758,026 | A | * | 4/1904 | Taylor | 70/421 |
| 1,257,987 | A | * | 3/1918 | Epstein | 70/493 |
| 2,049,548 | A | * | 8/1936 | Swanson | 70/493 |
| 2,174,413 | A | * | 9/1939 | Sigurd | 70/492 |
| 2,194,469 | A | * | 3/1940 | Fremon | 70/493 |
| 2,283,489 | A | * | 5/1942 | Crousore | 70/419 |
| 2,687,640 | A | * | 8/1954 | Mir et al. | 70/492 |
| 3,181,320 | A | * | 5/1965 | Bauer | 70/421 |
| 3,286,494 | A | | 11/1966 | Sussina | |
| 3,479,849 | A | * | 11/1969 | Check | 70/495 |
| 3,802,234 | A | | 4/1974 | Gerlach | |
| 3,837,197 | A | * | 9/1974 | Lopez | 70/494 |
| 3,857,263 | A | | 12/1974 | Gartner | |
| 4,078,406 | A | | 3/1978 | Genakis | |
| 4,098,103 | A | * | 7/1978 | Raskevicius | 70/494 |
| 4,213,316 | A | | 7/1980 | Tietz | |
| 4,222,252 | A | * | 9/1980 | Tietz | 70/495 |
| 4,377,082 | A | * | 3/1983 | Wolter | 70/493 |
| 4,377,940 | A | * | 3/1983 | Hucknall | 70/495 |
| 4,380,163 | A | | 4/1983 | Reder | |
| 4,638,651 | A | * | 1/1987 | Surko, Jr. | 70/495 |
| 4,753,091 | A | * | 6/1988 | Sheets | 70/493 |
| 5,488,847 | A | | 2/1996 | Lai et al. | |
| 6,601,419 | B2 | | 8/2003 | Huang et al. | |
| 6,675,617 | B2 | | 1/2004 | Stemmerik | |
| 2005/0022568 | A1 | | 2/2005 | Dolev | |

* cited by examiner

*Primary Examiner*—Lloyd A Gall
(74) *Attorney, Agent, or Firm*—Michael Best & Friedrich LLP

(57) ABSTRACT

A lock cylinder that includes a housing and a plug. The housing defines a cylindrical cavity, and an outer pin chamber in communication with the cavity. The plug is rotatable within the cavity, and includes a key slot, a cylindrical outer surface, and an inner pin chamber aligned with the outer pin chamber when the plug is in a locked position. An outer pin is housed in the outer pin chamber, and an inner pin is housed in the inner pin chamber. The inner pin is engageable with a key inserted into the key slot, and further engageable with the outer pin. The lock cylinder also includes a lock member in communication with the housing and the plug that selectively disables the lock cylinder in response to partial rotation of the plug from the locked position without an appropriate key in the key slot.

69 Claims, 7 Drawing Sheets

LOCK CYLINDER WITH LOCKING MEMBER

BACKGROUND

The present invention relates to a lock cylinder. More particularly, the present invention relates to a look cylinder that includes a housing and a plug.

Generally, lock cylinders include a housing and a plug that define respective pin chambers to receive pin pairs. The pin pairs include outer pins substantially disposed within the housing, and inner pins disposed within the plug. Springs are often used to bias the pin pairs toward a key slot in the plug. More specifically, the springs are engaged with the outer pins, which in turn engage the inner pins and force the inner pins into the key slot. In the absence of a correct or proper key, the outer pins are partially disposed in the plug and block rotation of the plug within the housing.

The plug is rotatable relative to the housing in most conventional lock cylinders. A shear line is defined where the plug and the housing come together. When an appropriate key is inserted into the key slot, the inner and outer pins are moved. The junctions of the inner pins and the outer pins are aligned with the shear line, which allows the plug to be turned to a locked or unlocked position. In other words, the appropriate key will move the inner and outer pins such that the outer pins are disposed completely in the housing, and the inner pins are disposed completely in the plug.

SUMMARY

In one embodiment, the invention provides a lock cylinder that includes a housing and a plug. The housing includes a cylindrical wall that has a cylindrical cavity, and an outer pin chamber in communication with the cavity. An outer pin is slidably housed in the outer pin chamber. The plug is disposed in the cavity and is rotatable within the cavity between a locked position and an unlocked position. The plug includes a generally cylindrical outer surface and an inner pin chamber that is aligned with the outer pin chamber when the plug is in the locked position. A key slot is disposed at least partially through the plug, and is in communication with the inner pin chamber. The lock cylinder also includes an inner pin that is slidably housed in the inner pin chamber, and that can engage a key inserted into the key slot. The inner pin is engageable with the outer pin when the plug is in the locked position. The lock cylinder also includes a lock member in communication with the housing and the plug that selectively disables the lock cylinder in response to partial rotation of the plug from the locked position without an appropriate key in the key slot.

In another embodiment, the invention provides a lock cylinder that includes a housing and a plug. The housing includes a cylindrical wall that defines a cylindrical cavity, and an outer pin chamber that is in communication with the cavity, and a recess that is in communication with the cavity. The recess is angularly spaced from the outer pin chamber, and an outer pin is slidably housed in the outer pin chamber. The plug is disposed in the cavity and is rotatable within the cavity between a locked position and an unlocked position. The plug includes a generally cylindrical outer surface and an inner pin chamber that is aligned with the outer pin chamber when the plug is in the locked position. A key slot is disposed at least partially through the plug, and is in communication with the inner pin chamber. The lock cylinder also includes an inner pin and a lock member. The inner pin is slidably housed in the inner pin chamber, and can engage with a key inserted into the key slot. The inner pin is engageable with the outer pin when the plug is in the locked position. The lock member movably is movable into the recess in response to partial rotation of the plug from the locked position without an appropriate key in the key slot.

In yet another embodiment, the invention provides a lock cylinder that includes a housing and a plug. The housing includes a cylindrical wall that defines a cylindrical cavity, and an outer pin chamber that is in communication with the cavity. An outer pin is slidably housed in the outer pin chamber. The plug is disposed in the cavity and is rotatable within the cavity between a locked position and an unlocked position. The plug includes a generally cylindrical outer surface and an inner pin chamber that is aligned with the outer pin chamber when the plug is in the locked position. A key slot is disposed at least partially through the plug, and is in communication with the inner pin chamber. The lock cylinder also includes an inner pin that is slidably housed in the inner pin chamber. The inner pin can engage a key inserted into the key slot, and can engage with the outer pin when the plug is in the locked position. A lock member is mounted on the plug for movement between a blocking position and a withdrawn position. The lock member can be engaged with the inner pin such that the lock member is held in the withdrawn position by the inner pin during rotation of the plug to the unlocked position with an appropriate key in the key slot.

In another embodiment the invention provides a method of operating a lock cylinder that includes a housing and a plug. The method includes permitting rotation of the plug from a locked position to an unlocked position when an appropriate key is inserted into a key slot of the plug, and resisting further rotation of the plug to the unlocked position after partial rotation of the plug from the locked position when an inappropriate key is inserted into the key slot.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
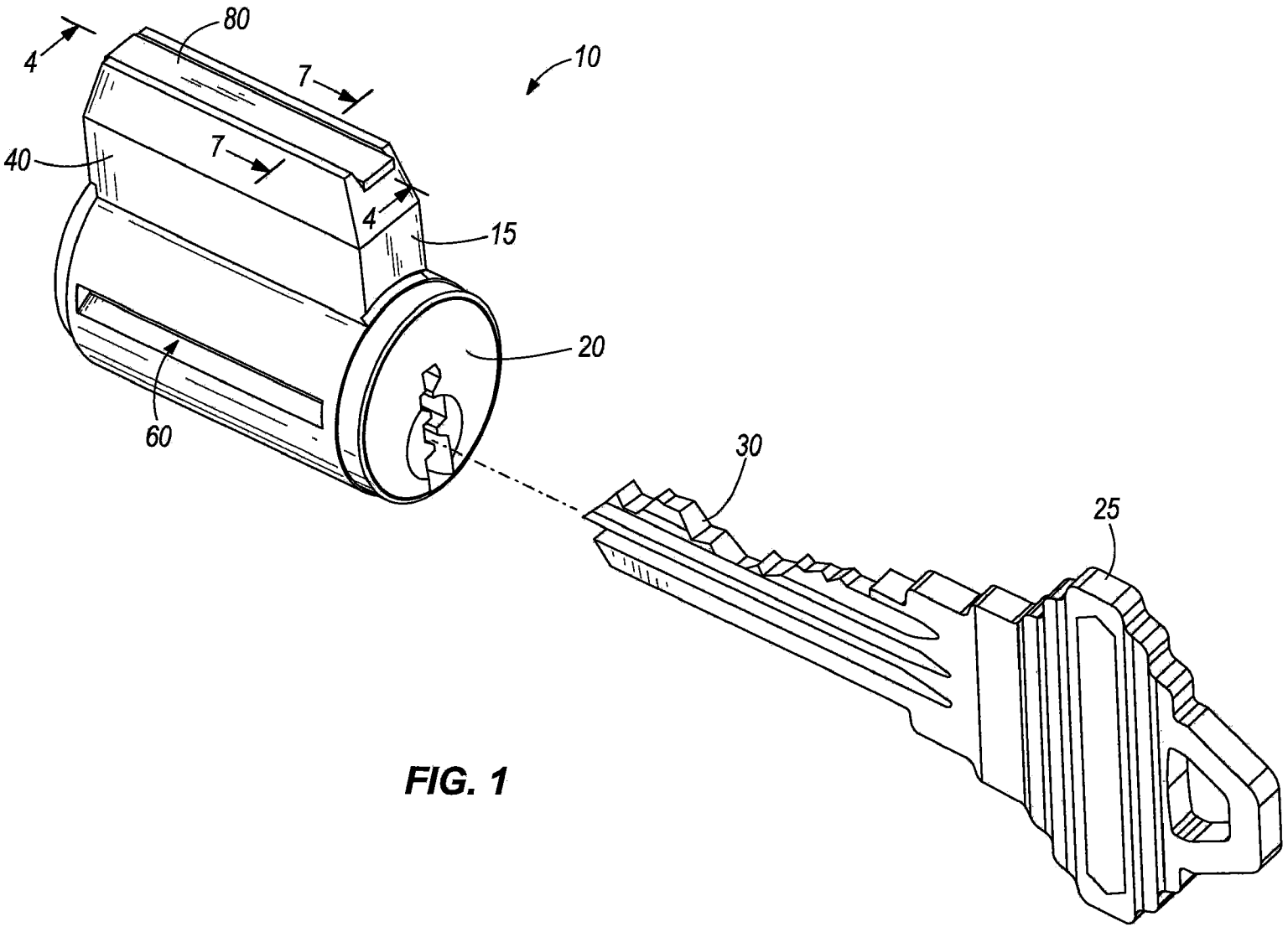
FIG. 1 is a perspective view of an exemplary lock cylinder of the present invention.

FIG. 1 shows a lock cylinder 10 for use with structures (e.g., doors, access panels, portable locks, etc.) that may be locked and unlocked. Hereinafter, the term "door" shall be used to represent all such lockable structures, and shall not be construed to limit the invention's application solely to doors. The lock cylinder 10 includes a housing 15 and a plug 20 configured to be selectively rotatable within the housing 15 using a key 25 that has pin engaging portions 30.

Figure 2:
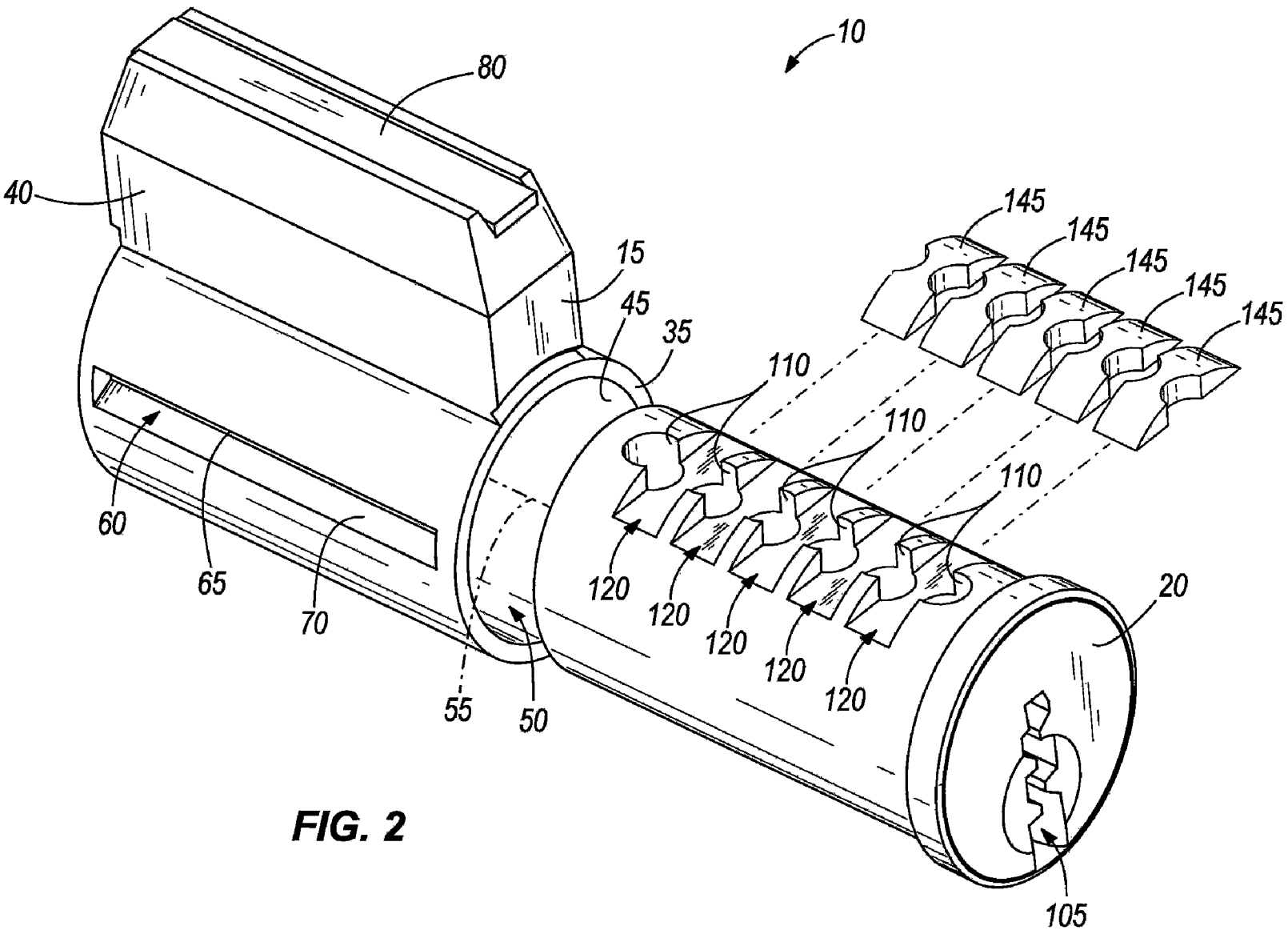
FIG. 2 is an exploded perspective view of the lock cylinder of FIG. 1, including a housing, a plug, and lock members.

The housing 15 is typically fixed relative to the door, and includes a wall 35 and a pin portion 40. As shown in FIG. 2, the wall 35 is substantially cylindrical and has an interior surface 45 that defines a cavity or hollow portion 50 configured to receive the plug 20. The cavity 50 has a generally horizontal central axis 55 that defines a generally horizontal plane bisecting the cavity 50.

FIGS. 1 and 2 show a recess 60 that is defined in the wall 35 by an upper wall 65 and a lower wall 70. The recess 60 is in communication with the cavity 50, and that extends generally parallel to the central axis 55. An interior opening to the recess 60 intersects the interior surface 45 along an axis 72 extending from a center of the housing 15 that is generally along a line above the plane. The lower wall 70 generally slopes downward away from the cavity 50. The recess 60 illustrated in FIG. 2 extends completely through the wall 35 from inside the cavity 50. In some embodiments, the recess 60 may extend partially through the wall 35 from the interior surface 45 without extending entirely through the wall 35.

Figure 4:
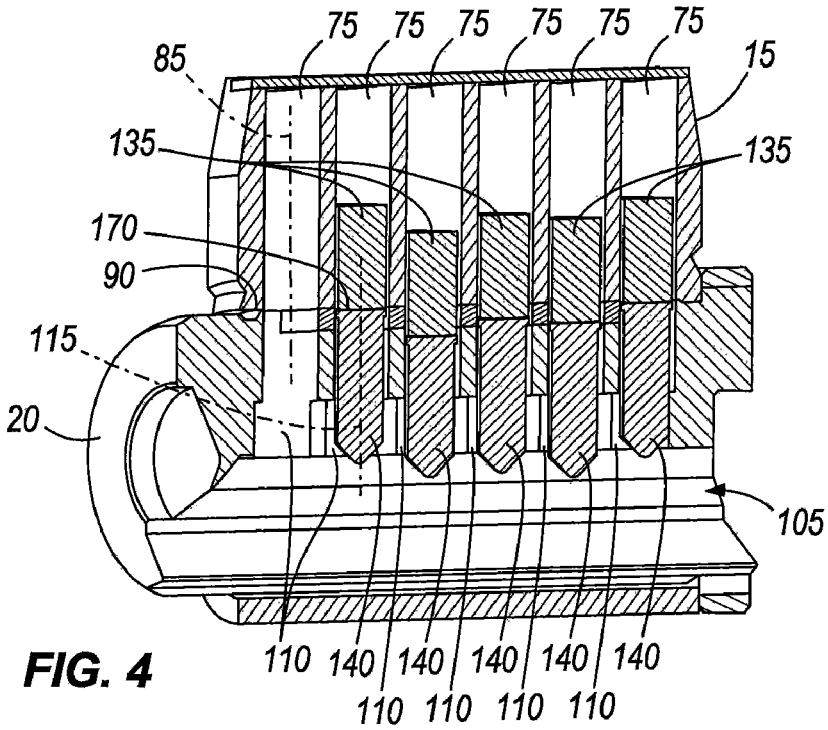
FIG. 4 is a section view of the lock cylinder taken along line 4-4 of FIG. 1.
Figure 5:
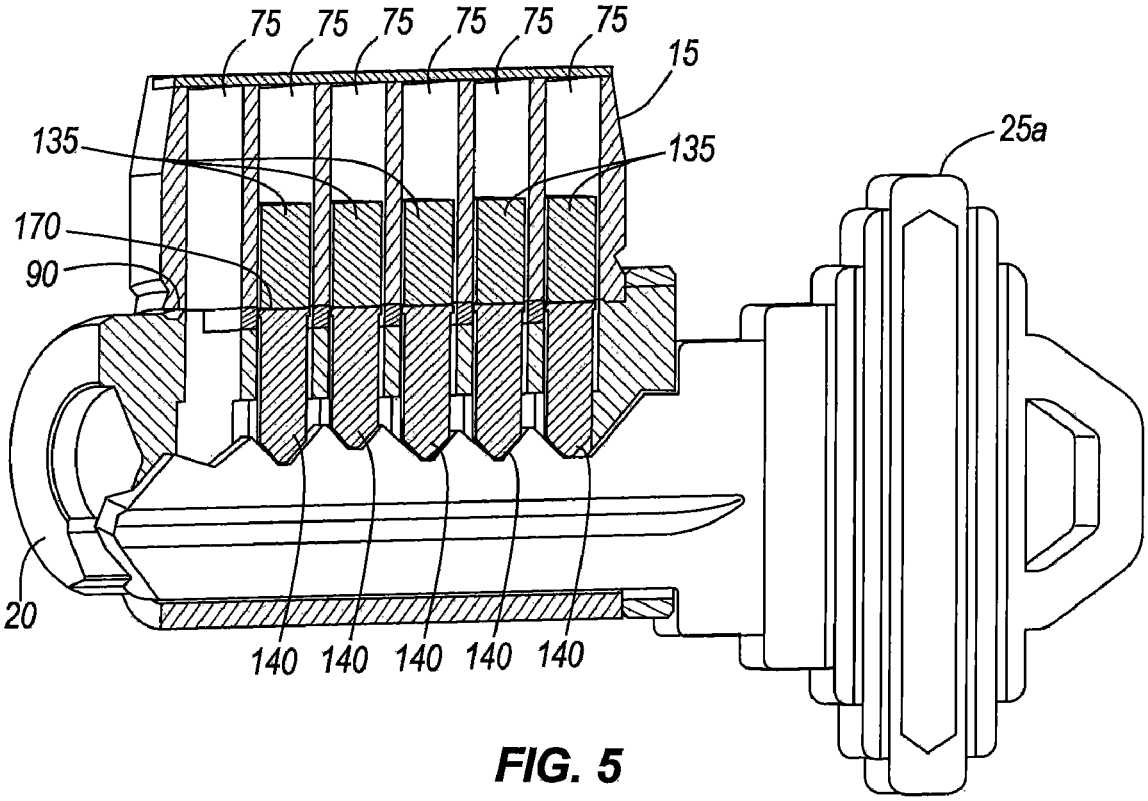
FIG. 5 is a view similar to FIG. 4 with an appropriate key inserted into the plug.
Figure 6:
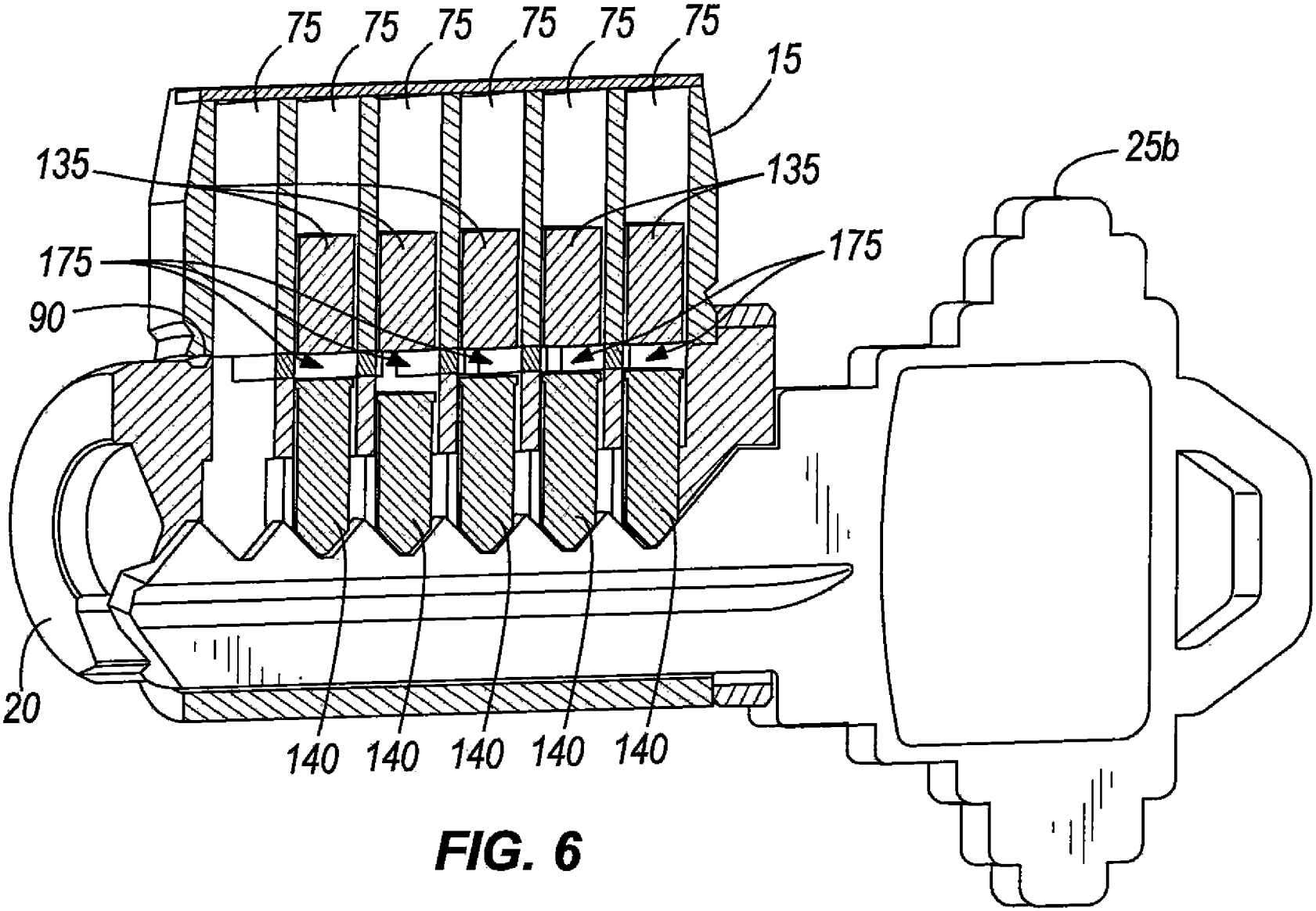
FIG. 6 is a view similar to FIG. 4 with an inappropriate key inserted into the plug.

FIG. 1 shows that the pin portion 40 extends upward from the wall 35 above the cavity 50. FIGS. 4-6 show that the pin portion 40 includes first or outer pin chambers 75. The outer pin chambers 75 are in communication with the cavity 50, and are accessible through a removable member 80 (FIGS. 1 and 2) adjacent an outer end of the pin portion 40.

Figure 7:
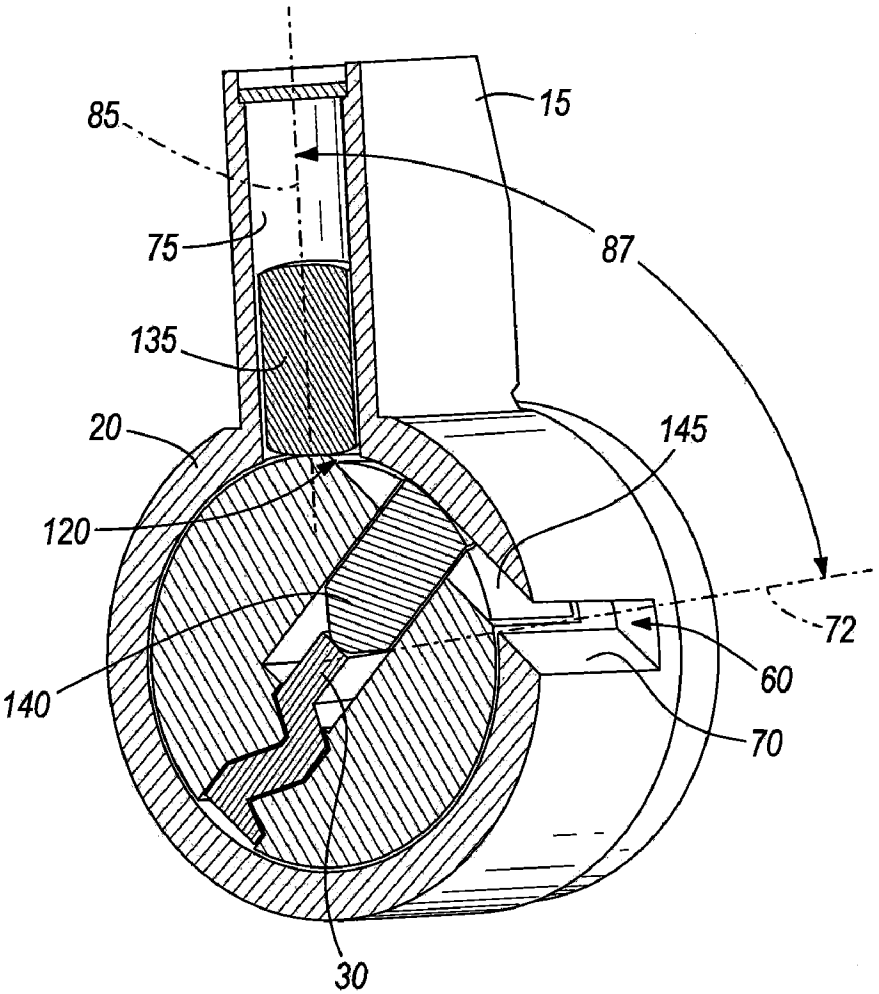
FIG. 7 is a perspective section view of the lock cylinder taken along line 7-7 of FIG. 1, including the plug rotated toward an unlocked position and the lock member in a withdrawn position.

FIG. 4 shows that each outer pin chamber 75 includes a first vertical axis 85 (one shown), and is oriented in the housing 15 such that the vertical axis 85 intersects the horizontal axis 55 defined by the cavity 50. As shown in FIG. 7, the outer pin chambers 75 are vertically disposed along one vertical axis 85 within the housing 15 such that the recess 60 is angularly spaced along a circumference or perimeter of the wall 35. In other words, the axis 72 of the recess 60 defines an angle 87 with respect to the vertical axis 85. In the illustrated construction, the angle 87 is about 60 degrees. In other constructions, the angle 87 can be between about 30 degrees and 90 degrees. FIGS. 4-6 show that the pin portion 40 includes six outer pin chambers 75, but fewer or more outer pin chambers 75 are within the scope of the invention.

The housing 15 and the plug 20 cooperate to define a shear line 90. The plug 20 can be rotated about the horizontal axis 55 between a locked position and an unlocked position after the plug 20 is inserted into the housing 15. The plug 20 is typically connected to a driver bar (not shown) or other structure for moving a latch (not shown) relative to the door to lock or unlock the door. Such arrangements are well known in the art.

Figure 3A:
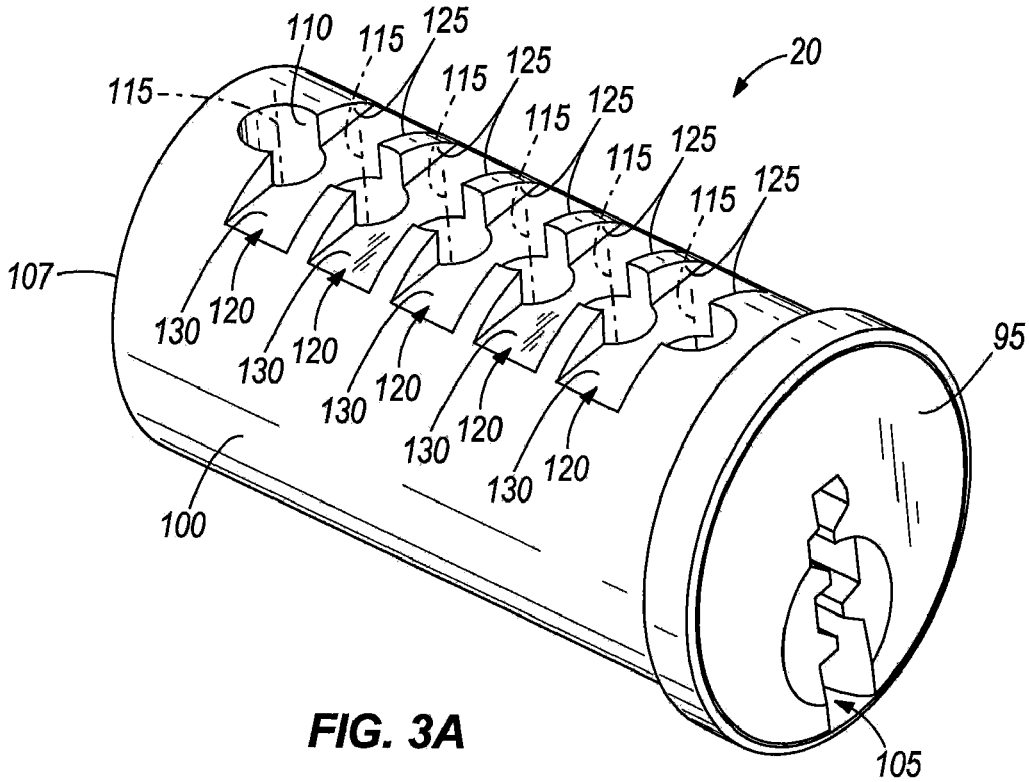
FIG. 3A is a perspective view of the plug of FIG. 2.
Figure 3B:
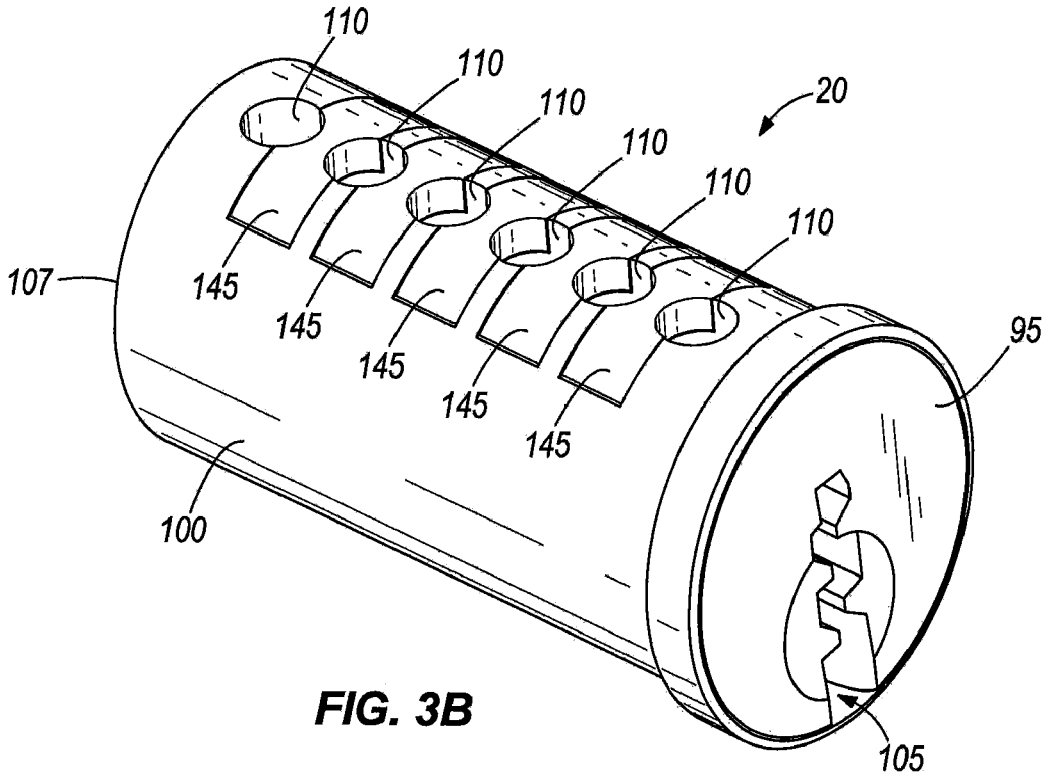
FIG. 3B is another perspective view of the plug and the lock members of FIG. 2, including the lock members engaged with the plug.

FIGS. 3A and 3B show that the plug 20 includes a body defined by a generally planar end surface 95, a generally cylindrical outer surface 100, and a key slot 105. The end surface 95 is accessible from the front of the lock cylinder 10. The cylindrical outer surface 100 has a substantially circular cross-section when viewed from the front of the lock cylinder 10.

The key slot 105 extends longitudinally through the plug 20 from the end surface 95 toward a rear portion 107 of the plug 20. The key slot 105 is accessible from adjacent the end surface 95.

FIGS. 2-4 show that the plug 20 also includes second or inner pin chambers 110 that extend from the cylindrical outer surface 100 toward the key slot 105 substantially transverse to the key slot 105. Each inner pin chamber 110 includes a second vertical axis 115 (FIG. 4, one shown), and defines a circular opening in the cylindrical outer surface 100 (FIG. 2). Each inner pin chamber 100 is aligned with a respective one of the outer pin chambers 75 when the plug 20 is in the locked position such that each first vertical axis 85 aligns with a respective second vertical axis 115. The second vertical axes 115 further cooperate to define a vertical plane. The key slot 105 is aligned with the vertical plane. The illustrated plug 20 includes six inner pin chambers 110. However, other embodiments of the plug 20 may include more or fewer than six inner pin chambers 110.

FIG. 2 shows that the plug 20 further includes grooves 120 disposed in the cylindrical outer surface 100 that extend between and intersect an adjacent pair of the inner pin chambers 110. As shown in FIG. 3A, the grooves 120 are defined by substantially parallel and opposed planar side walls 125 that are substantially parallel to the end surface 95. The grooves 120 are further defined by a bottom wall 130 that extends between and generally perpendicular to the side walls 125. Each bottom wall 130 is substantially planar, and is further substantially perpendicular to the second vertical axes 115 of the inner pin chambers 110. When the plug 20 is viewed from adjacent the end surface 95, the bottom walls 130 define a chord or segment of the circular cross-section of the cylindrical outer surface 100.

FIGS. 4-6 show that the pin portion 40 further includes a respective first or outer pin 135 in five of the six outer pin chambers 75. The outer pins 135 can be moved in a first or inward direction (downward in FIGS. 4-6) into the plug 20, and in a second or outward direction (upward in FIGS. 4-6) away from the plug 20. The outer pins 135 extend partially into the respective inner pin chambers 110, as shown in FIG. 4, when the plug 20 in the locked position and an appropriate key is not inserted into the key slot 105. In some embodiments, springs (not shown) can be positioned in the outer pin chambers 75 to bias the outer pins 135 inward. In other embodiments, the outer pins 135 may tend to move inward without the springs. In some embodiments, the outer pins 135 can move inward without engagement by springs due to orientation of the pin portion 40 above the plug (i.e., inward movement is assisted by gravity).

FIGS. 4-6 show that a respective second or inner pin 140 is disposed within five of the six inner pin chambers 110. The inner pins 140 are in communication with the key slot 105, and are positioned beneath and selectively engaged with the outer pins 135 when the plug 20 is in the locked position. Generally, the quantity of inner pins 140 will be the same as the quantity of outer pins 135. In some embodiments, the lock cylinder 10 can include six or more outer and inner pins 135, 140 (e.g., commercial applications). In other embodiments, the lock cylinder 10 can include fewer than five outer and inner pins 135, 140.

Figure 9:
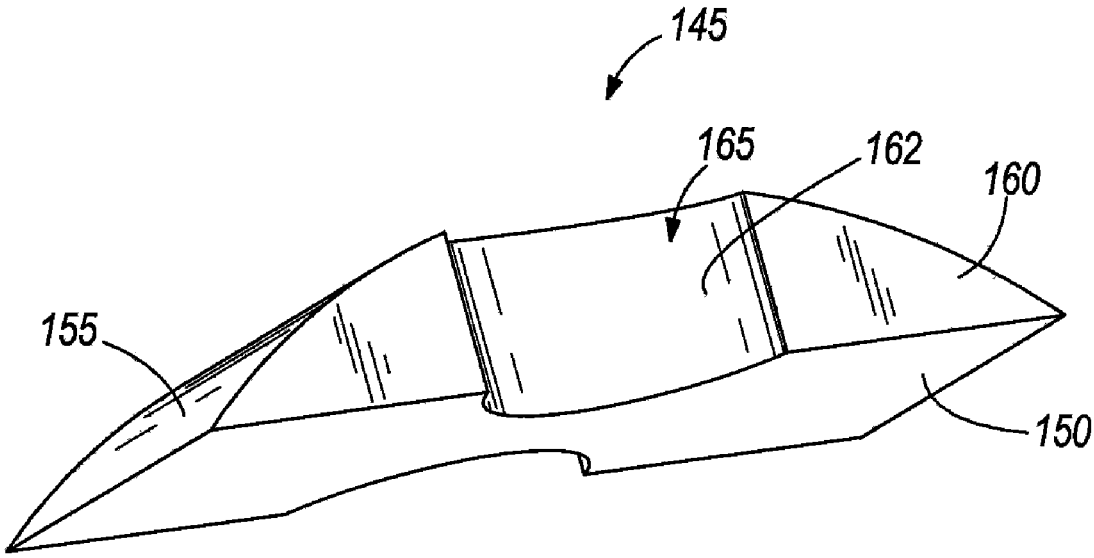
FIG. 9 is a perspective view of one of the lock members of FIG. 2.
Figure 10:
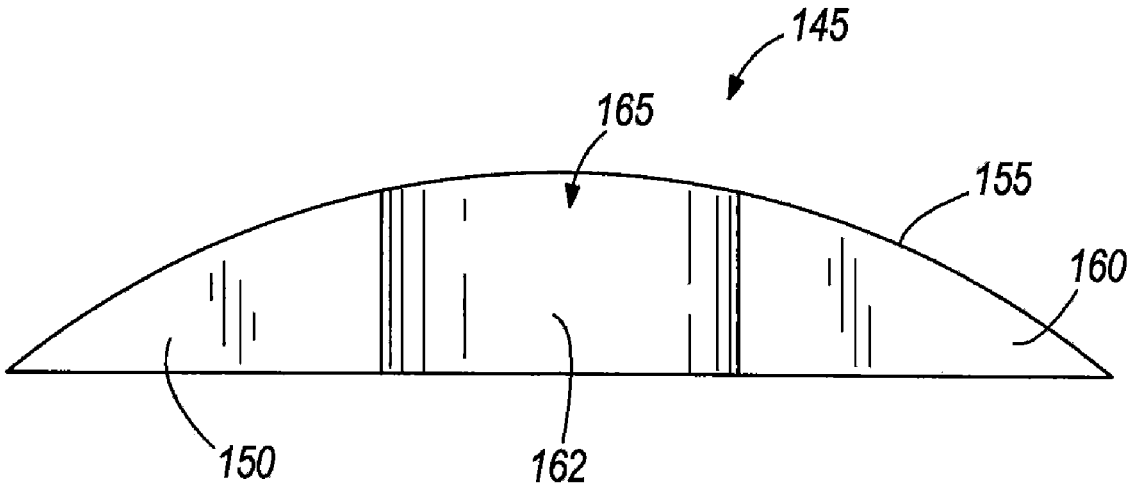
FIG. 10 is a side view of the lock member of FIG. 8.

FIGS. 2 and 3B show that the lock cylinder 10 also includes lock members 145 that can be positioned in respective grooves 120 and interposed between the housing 15 and the plug 20 generally toward a top of the plug 20. Each lock member 145 is further positioned between two inner pin chambers 110. FIGS. 9 and 10 show that each lock member 145 includes a planar bottom sin-face 150, a curved surface 155, and planar side surfaces 160. The bottom surface 150 is in communication with the planar bottom wall 130 of the respective groove 120 such that the lock member 145 is slidable within the groove 120. The curved surface 155 meets the bottom surface 150 to define a tapered end of the lock member 145 that is generally smaller than an opening to the recess 60.

As illustrated in FIG. 2, each side surface 160 faces a respective side wall 125 of the groove 120. Each side surface 160 includes a curved wall 162 that defines an arcuate recess 165 adjacent a central portion of the lock member 145. Each arcuate recess 165 is selectively aligned with one adjacent outer pin chamber 75 and one inner pin chamber 110 such that at least one of the outer pin 135 and the inner pin 140 can engage the lock member 145.

Each lock member 145 can be moved within the respective groove 120 between a first or withdrawn position and a second blocking or disabling position. FIG. 3B shows the lock members 145 positioned within the lock cylinder 10 in the withdrawn position. The withdrawn position is generally defined by alignment of the arcuate recesses 165 of each lock member 145 with the adjacent inner pin chambers 110. When the arcuate recesses 165 are aligned with the outer and inner pin chambers 75, 110, the arcuate recesses 165 define a portion of the inner pin chambers 110 such that at least one of the associated outer pin 135 and the inner pin 140 can engage the lock member 145 within the recess 165. The curved surface 155 defines a portion of a cylindrical surface that is coextensive with the cylindrical outer surface 100 when the lock member 145 is in the withdrawn position. The curved surface 155 is further generally concentric with the interior surface 45 of the wall 35 when the lock member is in the withdrawn position.

FIG. 7 shows the plug 20 partially rotated toward the unlocked position and one lock member 145 in the withdrawn position. Generally, the bottom wall 130 is substantially coplanar with and aligned with the lower wall 70 in response to partial rotation of the plug 20. However, after insertion of an appropriate key 25*a* (FIG. 5) having key engaging portions 30, the inner pin 140 is engaged with the lock member 145 within a corresponding arcuate recess 165, and the lock member 145 is not free to slide along the bottom wall 130 into the recess 60. The outer pin 135 is positioned completely within the outer pin chamber 75. In addition, the curved surface 155 of the lock member 145 remains coextensive with the cylindrical outer surface 100 of the plug 20 as the plug 20 is rotated to the unlocked position.

Figure 8:
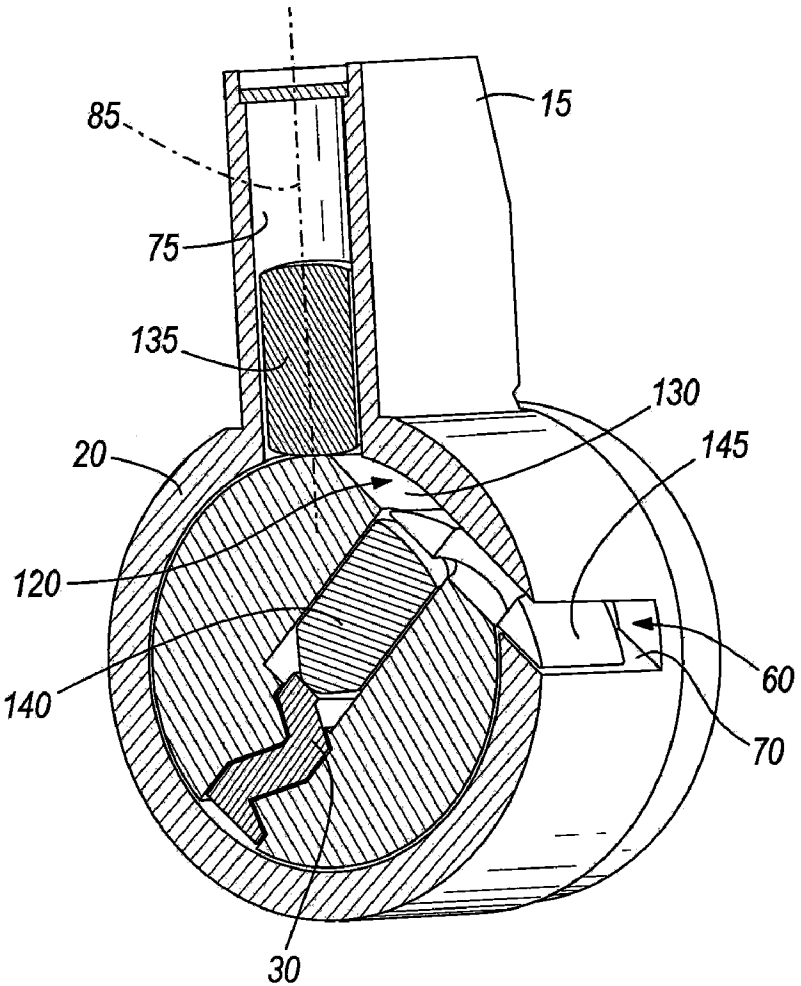
FIG. 8 is a perspective section view of the lock cylinder similar to FIG. 7, including the plug rotated toward an unlocked position and the lock member in a blocking position.

FIG. 8 shows the plug 20 partially rotated toward the unlocked position and the lock member 145 in the blocking position. Generally, the bottom wall 130 is substantially coplanar with and aligned with the lower wall 70 in response to partial rotation of the plug 20. When the bottom wall 130 is aligned with the lower wall 70, the lock member 145 is movable to the blocking position in a generally downward direction assisted by gravity when neither of the corresponding outer or inner pins 135, 140 are engaged with the lock member 145. In some embodiments, a spring or magnet or other device may assist movement of the lock member 145 toward the blocking position.

The blocking position of the lock member 145 is generally defined by the tapered end of the lock member 145 extending into the recess 60, and a portion of the bottom surface 150 of the lock member 145 being engaged with the lower wall 70. The arcuate recesses 165 of each lock member 145 are not aligned with the outer pin chambers 75 or the inner pin chambers 110 when the lock member 145 is in the blocking position. As such, the curved surface 155 is no longer coextensive with the curved outer surface 100, and the curved surface 155 of the lock member 145 is no longer concentric with the interior surface 45 of the wall 35. The plug 20 cannot be rotated to the unlocked position when the lock member 145 is in the blocking position. In other words, when neither the outer pin nor the inner pin is engaged with the lock member and when the lock member is in the blocking position in response to partial rotation of the plug, the lock member disables the lock cylinder by preventing rotation of the plug to the unlocked position.

FIG. 4 shows the lock cylinder 10 without the key 25 in the key slot 105. The outer pins 135 and the inner pins 140 extend inward into the plug 20 such that the outer pins 135 are partially disposed in the inner pin chambers 110 without the key 25 in the key slot. The inner pins 140 are in communication with the key slot 105 for selective engagement by the key 25. Engagement of the outer pins 135 with the inner pins 140 defines a parting line 170 between the respective outer pins 135 and inner pins 140. In the embodiment illustrated in FIG. 4, the outer pins 135 are engaged with the inner pins 140 due to gravity. As discussed above, the outer pins 135 can also be engaged with the inner pins 140 due to bias from springs positioned in the outer pin chambers 75.

The outer pins 135 also extend at least partially through the arcuate recesses 165 of adjacent lock members 145 when the plug 20 is in the locked position and without the key 25 in the key slot 105. The outer pins 135 are engaged with the lock members 145 within the arcuate recesses 165 to hold the lock members 145 in the withdrawn position, and to prevent rotation of the plug 20 toward the unlocked position.

FIGS. 5 and 7 show the appropriate key 25*a* inserted into the key slot 105. In operation, insertion of the appropriate key 25*a* into the key slot 105 permits rotation of the plug 20 from the locked position to the unlocked position. The key engaging portions 30 of the appropriate key 25*a* engage the inner pins 140, which move the respective outer pins 135 outward (upward in FIG. 5) to align the parting lines 170 with the shear line 90. Due to alignment of the inner pin chambers 110 with the arcuate recesses 165, the inner pins 140 generally extend into the arcuate recesses 165 of adjacent lock members 145 when the parting lines 170 are aligned with the shear line 90, and hold the lock members 145 in the withdrawn position. The outer pins 135 are no longer engaged with the lock members 145 within the arcuate recesses 165 when the parting lines 170 are aligned with the shear line 90.

As shown in FIG. 7, the inner pins 140 are engaged with the lock members 145 and extend into the arcuate recesses 165 to hold the lock members 145 in the withdrawn position when the plug 20 is rotated away from the locked position with the appropriate key 25*a* in the key slot 105. Engagement of the inner pins 140 with the lock members 145 inhibits movement of the lock members 145 relative to the plug 20 so that the plug 20 can be rotated to the unlocked position. The curved surface 155 of the lock member 145 generally follows the curved interior surface 45 of the wall 35 and remains concentric with the interior surface 45 when the plug 20 is rotated to the unlocked position with the appropriate key 25*a*.

FIGS. 6 and 8 show the inappropriate key 25*b* inserted into the key slot 105. In some embodiments, upon insertion of the inappropriate key 25*b*, at least one parting line 170 is not aligned with the shear line 90, and the plug 20 cannot rotate to the unlocked position. In these embodiments, the plug 20 generally cannot be rotated to the unlocked position because at least one of the outer pins 135 may be engaged with the corresponding lock member 145 within the arcuate recess 165.

In other embodiments, the inner pins 140 can be bumped using the inappropriate key 25*b* such that one or more of the inner pins 140 may engage the outer pins 135. As illustrated in FIG. 6, a gap or void 175 can form between each outer pin 135 and the respective inner pin 140 when the inner pin 140 is bumped with the inappropriate key 25*b*. When the gap 175 is formed, the respective lock member 145 is not engaged by the adjacent outer pins 135 or by the adjacent inner pins 140. If additional gaps 175 exist between one or more of the remaining outer and inner pins 135, 140, or if the remaining parting lines 170 are aligned with the shear line 90, or any combination of gaps 175 and alignment of parting lines 170 with the shear line 90, the plug 20 can be rotated toward the unlocked position. However, as illustrated in FIG. 8, when a gap 175 is formed between outer and inner pins 135, 140, the lock member 145 is generally free to slide within the groove 120 into the blocking position when the plug 20 is rotated toward the unlocked position. As such, the lock member 145 prevents the plug 20 from rotating to the unlocked position. In some embodiments, the lock member 145 slides within the groove 120 into the recess 60 under the force of gravity.

The lock member 145 is movable into engagement with the recess 60 to inhibit rotation of the plug 20 to the unlocked position in response to partial rotation of the plug 20 without insertion of the appropriate key 25*a* into the key slot 105. The grooves 120 generally become oriented in a generally downward direction when the plug 20 is rotated toward the unlocked position. Each lock member 145 not engaged by the adjacent outer or inner pins 135, 140 slides along the bottom wall 130 and the side walls 125 of the respective groove 120 toward the blocking position in response to the groove 120 being oriented in the downward direction. Continued rotation of the plug 20 relative to the housing 15 toward the unlocked position aligns the bottom wall 130 with the lower wall 70 of the recess 60, which enables the tapered end of the lock member 145 to slide into the blocking position and to lodge within the recess 60. The blocking position of the lock member 145 resists further rotation of the plug 20 toward the unlocked position. In some embodiments, engagement of the lock member 145 with the recess 60 can inhibit rotation of the plug 20 relative to the housing 15 toward the locked position, in addition to inhibiting further rotation toward the unlocked position.

Various features and advantages of the invention are set forth in the following claims.

What is claimed is:

1. A lock cylinder comprising:

a housing including a cylindrical wall defining a cylindrical cavity, a recess defined in the cylindrical wall and in communication with the cavity, and an outer pin chamber communicating with the cavity;

an outer pin slidably housed in the outer pin chamber;

a plug disposed in the cavity and being rotatable within the cavity between a locked position and an unlocked position, the plug having a generally cylindrical outer surface and having an inner pin chamber that is aligned with the outer pin chamber when the plug is in the locked position;

a key slot disposed at least partially through the plug, the key slot communicating with the inner pin chamber;

an inner pin slidably housed in the inner pin chamber, the inner pin being engageable with a key inserted into the key slot, and the inner pin being engageable with the outer pin when the plug is in the locked position; and a lock member in communication with the housing and the plug, the lock member movable into engagement with the recess to inhibit rotation of the plug to the unlocked position in response to partial rotation of the plug from the locked position without an appropriate key in the key slot.

2. The lock cylinder of claim 1, wherein the lock member is positioned between the housing and the plug, the lock member movable between a first position and a second position.

3. The lock cylinder of claim 2, wherein the plug defines a groove disposed in the cylindrical outer surface, the lock member slidable between the first position and the second position within the groove.

4. The lock cylinder of claim 3, wherein the cylindrical outer surface defines a circular cross-section, wherein the groove is defined by parallel opposed side walls and a bottom wall extending between the side walls, and wherein the bottom wall defines a chord of the circular cross-section.

5. The lock cylinder of claim 4, wherein the bottom wall of the groove is defined by a substantially planar surface.

6. The lock cylinder of claim 4, wherein the lock member includes a first surface in communication with the bottom wall, and a second surface defining a cylindrical surface coextensive with the cylindrical outer surface of the plug when the lock member is in the first position.

7. The lock cylinder of claim 6, wherein the second surface meets the first surface to define a tapered end of the lock member that is smaller than an opening to the recess.

8. The lock cylinder of claim 4, wherein the lock member includes substantially parallel side surfaces, and wherein each of the side surfaces is slidable along a respective side wall of the groove.

9. The lock cylinder of claim 8, wherein at least one side surface defines an arcuate recess aligned with the inner pin chamber when the lock member is in the first position such that the inner pin can be engaged with the lock member within the arcuate recess.

10. The lock cylinder of claim 9, wherein the plug defines a plurality of inner pin chambers, wherein the lock member is positioned between two of the plurality of inner pin chambers such that an arcuate recess defined in each side surface is aligned with a respective one of the two inner pin chambers when the lock member is in the first position, and wherein the two inner pin chambers house respective inner pins such that the inner pins can be engaged with the lock member within the respective arcuate recesses.

11. The lock cylinder of claim 1, wherein the recess extends partially through the cylindrical wall from inside the cavity.

12. The lock cylinder of claim 1, wherein the outer pin chamber defines a vertical axis, and wherein the recess is angularly spaced between about 30 degrees and 90 degrees from the vertical axis along a circumference of the housing.

13. The lock cylinder of claim 12, wherein the lock member is positioned adjacent a top of the plug when the lock member is in a first position, and wherein the lock member is slidable into the recess.

14. The lock cylinder of claim 13, wherein the lock member is slidable into the recess under the force of gravity.

15. The lock cylinder of claim 1, wherein the cavity includes a horizontal axis generally defining a horizontal plane bisecting the cavity, and wherein the recess intersects the cylindrical wall generally above the plane.

16. The lock cylinder of claim 1, wherein the recess is defined by a wall sloping generally downward away from the cavity.

17. The lock cylinder of claim 16, wherein the cylindrical outer surface includes a groove defined by a bottom wall, and wherein the bottom wall defining the groove is coplanar with and aligned with the wall defining the recess in response to partial rotation of the plug toward the unlocked position.

18. The lock cylinder of claim 17, wherein, without an appropriate key in the key slot, the lock member is slidable from along the bottom wall to along the wall defining the recess such that the lock member is partially engaged with the cylindrical wall of the housing.

19. The lock cylinder of claim 18, wherein the lock member is slidable into the recess in a generally downward direction.

20. The lock cylinder of claim 1, wherein the inner pin is engaged with the lock member in response to insertion of an appropriate key into the key slot such that the lock member is substantially immovable, and such that the plug is rotatable to the unlocked position in response to the lock member being substantially immovable.

21. The lock cylinder of claim 1, wherein the lock member is configured to disable the lock cylinder in response to partial rotation of the plug from the locked position when neither the outer pin nor the inner pin is engaged with the lock member.

22. A lock cylinder comprising:

a housing including a cylindrical wall defining a cylindrical cavity, an outer pin chamber communicating with the cavity and defining a vertical axis, and a recess communicating with the cavity, the recess being angularly spaced from the vertical axis of the outer pin chamber;

an outer pin slidably housed in the outer pin chamber;

a plug disposed in the cavity and being rotatable within the cavity between a locked position and an unlocked position, the plug having a generally cylindrical outer surface and having an inner pin chamber that is aligned with the outer pin chamber when the plug is in the locked position;

a key slot disposed at least partially through the plug, the key slot communicating with the inner pin chamber;

an inner pin slidably housed in the inner pin chamber, the inner pin being engageable with a key inserted into the key slot, and the inner pin being engageable with the outer pin when the plug is in the locked position; and a lock member movably mounted on the plug, the lock member being movable into the recess in response to partial rotation of the plug from the locked position without an appropriate key in the key slot.

23. The lock cylinder of claim 22, wherein the lock member is positioned between the housing and the plug.

24. The lock cylinder of claim 22, wherein the lock member includes a first surface and a second surface, and wherein the second surface meets the first surface to define a tapered end of the lock member that is smaller than an opening to the recess.

25. The lock cylinder of claim 24, wherein the lock member is movable between a first position and a second position, and wherein the second surface defines a cylindrical surface coextensive with the cylindrical outer surface of the plug when the lock member is in the first position.

26. The lock cylinder of claim 25, wherein the lock member further includes substantially parallel side surfaces, and wherein at least one side surface defines an arcuate recess aligned with the inner pin chamber when the lock member is in the first position such that the inner pin can be engaged with the lock member within the arcuate recess.

27. The lock cylinder of claim 26, wherein the plug defines a plurality of inner pin chambers, wherein the lock member is positioned between two of the plurality of inner pin chambers such that each side surface of the lock member includes an arcuate recess aligned with a respective one of the two inner pin chambers when the lock member is in the first position, and wherein the two inner pin chambers house respective inner pins such that the inner pins can be engaged with the lock member within the respective arcuate recesses.

28. The lock cylinder of claim 26, wherein the cylindrical outer surface includes a groove defined by a bottom wall.

29. The lock cylinder of claim 28, wherein the lock member is slidable within the groove along the bottom wall.

30. The lock cylinder of claim 28, wherein the groove is defined by parallel opposed side walls and a bottom wall extending between the side walls, and wherein each of the side surfaces of the lock member is slidable along a respective side wall of the groove.

31. The lock cylinder of claim 28, wherein the bottom wall of the groove is defined by a substantially planar surface.

32. The lock cylinder of claim 31, wherein the recess is defined by a wall sloping generally downward away from the cavity.

33. The lock cylinder of claim 32, wherein the bottom wall defining the groove is coplanar with and aligned with the wall defining the recess in response to partial rotation of the plug toward the unlocked position.

34. The lock cylinder of claim 33, wherein, without an appropriate key in the key slot, the lock member is slidable from along the bottom wall to along the wall defining the recess such that the lock member is partially engaged with the cylindrical wall of the housing.

35. The lock cylinder of claim 34, wherein the lock member is slidable into the recess in a generally downward direction.

36. The lock cylinder of claim 35, wherein the lock member is slidable into the recess assisted by gravity.

37. The lock cylinder of claim 22, wherein the recess extends partially through the cylindrical wall from inside the cavity.

38. The lock cylinder of claim 22, wherein the recess is angularly spaced between about 30 degrees and 90 degrees from the vertical axis along a circumference of the housing.

39. The lock cylinder of claim 22, wherein the lock member is movable into the recess under the force of at least one of a spring, a magnet, and gravity.

40. The lock cylinder of claim 22, wherein the cavity includes a horizontal axis generally defining a horizontal plane bisecting the cavity, and wherein the recess intersects the cylindrical wall generally above the plane.

41. The lock cylinder of claim 22, wherein the inner pin is engaged with the lock member in response to insertion of an appropriate key into the key slot such that the lock member is substantially immovable, and such that the plug is rotatable to the unlocked position in response to the lock member being substantially immovable.

42. The lock cylinder of claim 22, wherein the lock member is configured to disable the lock cylinder in response to partial rotation of the plug from the locked position when neither the outer pin nor the inner pin is engaged with the lock member.

43. A lock cylinder comprising:

a housing including a cylindrical wall defining a cylindrical cavity and an outer pin chamber communicating with the cavity;

an outer pin slidably housed in the outer pin chamber;

a plug disposed in the cavity and being rotatable within the cavity between a locked position and an unlocked position, the plug having a generally cylindrical outer surface and having an inner pin chamber that is aligned with the outer pin chamber when the plug is in the locked position;

a key slot disposed at least partially through the plug, the key slot communicating with the inner pin chamber;

an inner pin slidably housed in the inner pin chamber, the inner pin being engageable with a key inserted into the key slot, and the inner pin being engageable with the outer pin when the plug is in the locked position; and a lock member mounted on the plug for movement between a blocking position and a withdrawn position, the lock member being engageable with the inner pin such that the lock member is held in the withdrawn position by the inner pin during rotation of the plug to the unlocked position with an appropriate key in the key slot, the lock member movable into the blocking position and configured to disable the lock cylinder when no outer pin and no inner pin are engaged with the lock member.

44. The lock cylinder of claim 43, wherein the lock member is positioned between the housing and the plug.

45. The lock cylinder of claim 43, wherein the plug defines a groove disposed in the cylindrical outer surface, wherein the groove is defined by a bottom wall, and wherein the lock member includes a first surface in communication with the bottom wall, and a second surface defining a cylindrical surface coextensive with the cylindrical outer surface of the plug when the lock member is in the withdrawn position.

46. The lock cylinder of claim 45, wherein the housing includes a recess defined in the cylindrical wall and in communication with the cavity, and wherein the second surface meets the first surface to define a tapered end of the lock member that is smaller than an opening to the recess.

47. The lock cylinder of claim 46, wherein the lock member further includes substantially parallel side surfaces, and wherein at least one side surface defines an arcuate recess that is aligned with the inner pin chamber when the lock member is in the withdrawn position such that the inner pin can be engaged with the lock member within the arcuate recess.

48. The lock cylinder of claim 47, wherein each side surface defines an arcuate recess, and wherein each arcuate recess is aligned with a respective inner pin chamber when the lock member is in the withdrawn position such that an inner pin of the respective inner pin chamber can be engaged with the lock member within each arcuate recess.

49. The lock cylinder of claim 43, wherein the cylindrical outer surface includes a groove defined by a bottom wall, and wherein the lock member is slidable within the groove along the bottom wall between the withdrawn position and the blocking position.

50. The lock cylinder of claim 49, wherein the groove is further defined by parallel opposed side walls, and wherein the lock member is slidable along the side walls of the groove.

51. The lock cylinder of claim 49, wherein the housing includes a recess defined in the cylindrical wall and in communication with the cavity, wherein the recess is further defined by a wall, and wherein the lock member moves into the recess when the lock member slides to the blocking position.

52. The lock cylinder of claim 51, wherein the bottom wall defining the groove is coplanar with and aligned with the wall defining the recess in response to partial rotation of the plug toward the unlocked position.

53. The lock cylinder of claim 52, wherein, without an appropriate key in the key slot, the lock member is slidable from along the bottom wall to along the wall defining the recess such that the lock member is partially engaged with the cylindrical wall of the housing.

54. The lock cylinder of claim 52, wherein the wall defining the recess slopes generally downward away from the cavity.

55. The lock cylinder of claim 51, wherein the outer pin chamber defines a vertical axis, and wherein the recess is angularly spaced from between about 30 degrees and 90 degrees from the vertical axis along a circumference of the housing.

56. The lock cylinder of claim 51, wherein the recess extends partially through the cylindrical wall from inside the cavity.

57. The lock cylinder of claim 51, wherein the lock member is positioned adjacent a top of the plug when the lock member is in the withdrawn position, and wherein the lock member is slidable into the recess.

58. The lock cylinder of claim 57, wherein the lock member is slidable into the recess under the force of gravity.

59. The lock cylinder of claim 51, wherein the cavity includes a horizontal axis generally defining a horizontal plane bisecting the cavity, and wherein the recess intersects the cylindrical wall generally above the plane.

60. The lock cylinder of claim 43, wherein the lock member is slidable to the blocking position in a generally downward direction.

61. The lock cylinder of claim 43, wherein the inner pin is engaged with the lock member in response to insertion of an appropriate key into the key slot such that the lock member is substantially immovable, and such that the plug is rotatable to the unlocked position in response to the lock member being substantially immovable.

62. The lock cylinder of claim 43, wherein the housing further includes a recess defined in the cylindrical wall and in communication with the cavity, and wherein movement of the lock member into the blocking position includes movement of the lock member into the recess.

63. The lock cylinder of claim 62, wherein the lock member is engaged with the recess in response to partial rotation of the plug from the locked position to inhibit rotation of the plug to the unlocked position.

64. A lock cylinder comprising:

a housing including a cylindrical wall defining a cylindrical cavity, an outer pin chamber communicating with the cavity, and a recess defined in the cylindrical wall and in communication with the cavity, the recess defined by a wall sloping generally downward away from the cavity;

an outer pin slidably housed in the outer pin chamber;

a plug disposed in the cavity and being rotatable within the cavity between a locked position and an unlocked position, the plug having a generally cylindrical outer surface with a groove defined by a bottom wall coplanar and aligned with the wall defining the recess in response to partial rotation of the plug toward the unlocked position, the plug further having an inner pin chamber that is aligned with the outer pin chamber when the plug is in the locked position;

a key slot disposed at least partially through the plug, the key slot communicating with the inner pin chamber;

an inner pin slidably housed in the inner pin chamber, the inner pin being engageable with a key inserted into the key slot, and the inner pin being engageable with the outer pin when the plug is in the locked position; and a lock member slidable within the groove along the bottom wall between a withdrawn position and a blocking position, the lock member engageable with the inner pin such that the lock member is held in the withdrawn position by the inner pin during rotation of the plug to the unlocked position with an appropriate key in the key slot, the lock member moving into the recess such that the lock member is in the blocking position without an appropriate key in the key slot.

65. The lock cylinder of claim 64, wherein the lock member is movable into the recess under the force of at least one of a spring, a magnet, and gravity.

66. The lock cylinder of claim 64, wherein the lock member is configured to disable the lock cylinder in response to partial rotation of the plug from the locked position when no outer pin and no inner pin are engaged with the lock member.

67. The lock cylinder of claim 64, wherein the lock member includes side surfaces, and wherein at least one side surface defines an arcuate recess aligned with the inner pin chamber when the lock member is in the withdrawn position such that the inner pin can be engaged with the lock member within the arcuate recess.

68. The lock cylinder of claim 67, wherein the plug defines a plurality of inner pin chambers, wherein the lock member is positioned between two of the plurality of inner pin chambers such that an arcuate recess defined in each side surface is aligned with a respective one of the two inner pin chambers when the lock member is in the withdrawn position, and wherein the two inner pin chambers house respective inner pins such that the inner pins can be engaged with the lock member within the respective arcuate recesses.

69. The lock cylinder of claim 64, wherein the outer pin chamber defines a vertical axis, and wherein the recess is angularly spaced between about 30 degrees and 90 degrees from the vertical axis along a circumference of the housing.

* * * * *